United States Patent [19]

Bolton

[11] 3,980,303

[45] Sept. 14, 1976

[54] GAME STRUCTURE

[75] Inventor: Douglas R. Bolton, Palatine, Ill.

[73] Assignee: Cadaco, Inc., Chicago, Ill.

[22] Filed: July 6, 1972

[21] Appl. No.: 269,502

[52] U.S. Cl. ..... 273/95 R; 273/106.5 A; 273/102 R

[51] Int. Cl.[2] ..... A63B 71/02

[58] Field of Search ..... 273/95 R, 102 R, 102 B, 273/106.5 R, 106.5 A; 46/DIG. 1

[56] References Cited

UNITED STATES PATENTS 2,683,037 7/1954 Ruczynski ..... 273/106.5 A

*Primary Examiner*—Richard C. Pinkham
*Assistant Examiner*—Marvin Siskind
*Attorney, Agent, or Firm*—Hofgren, Wegner, Allen, Stellman & McCord

[57] ABSTRACT

A structure for playing a game including a sheet of material adapted to be retained against a wall surface, and a plurality of darts having forwardly projecting barbs adapted to hook into the front surface of the sheet. The sheet may be suitably marked to define a game playing field, such as for scoring. The darts include a resilient pad for absorbing inertia forces to facilitate retention of the darts on the sheet by the hooking action.

12 Claims, 3 Drawing Figures

GAME STRUCTURE

BACKGROUND OF THE INVENTION

1. Field of the Invention

This invention relates to apparatus for playing games and in particular to apparatus for playing a dart game.

2. Description of the Prior Art

In one prior art form of dart game, a plurality of darts are provided with sharp metal tips adapted to penetrate a dart board provided with a suitable marked field to provide scoring and the like. Such sharp tipped darts present a safety problem in that serious injury can result from accidental striking of a person by a thrown dart. Further, quite often the darts might miss the dart board and damage the adjacent wall surface. One solution to this problem has been to provide darts with rubber suction cups in lieu of the sharp tips and use therewith a relatively smooth surface dart board to permit the suction cup darts to adhere to it. It has been found that such suction cup darts do not provide a fully satisfactory answer to the problem because of failure to adhere, such as when striking the board at other than a perpendicular angle, and further, such suction cup devices have been found to tend to deteriorate over a period of time, preventing proper suction action on impact.

One other attempted solution to the problem has been to use a fabric dart board and a barbed nose portion on the darts cooperating with the dart board fabric to retain the thrown dart. Such prior art barbed darts have presented the problem of impositive retention upon striking the dart board.

SUMMARY OF THE INVENTION

The present invention comprehends an improved dart game structure effectively eliminating the disadvantages of the prior art structures as discussed above in a novel and simple manner.

More specifically the present invention comprehends providing such a dart game structure including a target sheet of material having a front surface portion comprising a plurality of fibers defining a plurality of interstitial spaces, and a dart having a substantially rigid grasping portion, a nose portion at the front end of the grasping portion comprising a plurality of forwardly projecting barbs adapted to pass into the interstitial spaces and releasably hook the fibers to releasably hold the dart to the sheet as an incident of throwing of the dart to impact the nose against the front surface portion, and resilient support means mounting the nose portion to the grasping portion for absorbing deceleration energy resulting from the impact of the dart against the sheet to effectively preclude bouncing-off of the dart nose portion upon impact with the sheet.

The resilient support means illustratively comprises a pad of compressible plastic material such as foamed polyurethane. The target sheet illustratively is flexible and adapted to be hung on a wall. The fiber front portion may be defined by a woven textile fabric of a material such as nylon. The target sheet may further be provided with a resilient layer rearwardly of the fiber portion which illustratively may be formed of foamed plastic such as polyurethane. Further, the target sheet may be provided with a rear fabric layer.

The grasping portion of the dart may be provided at its forward end with a transversely enlarged head. The resilient support may comprise a compressible pad adhesively secured to the front surface of the head and the barbed means may be provided with a fabric base adhesively secured to the front surface of the pad for facilitated manufacture.

The game playing structure of the present invention is extremely simple and economical of manufacture while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
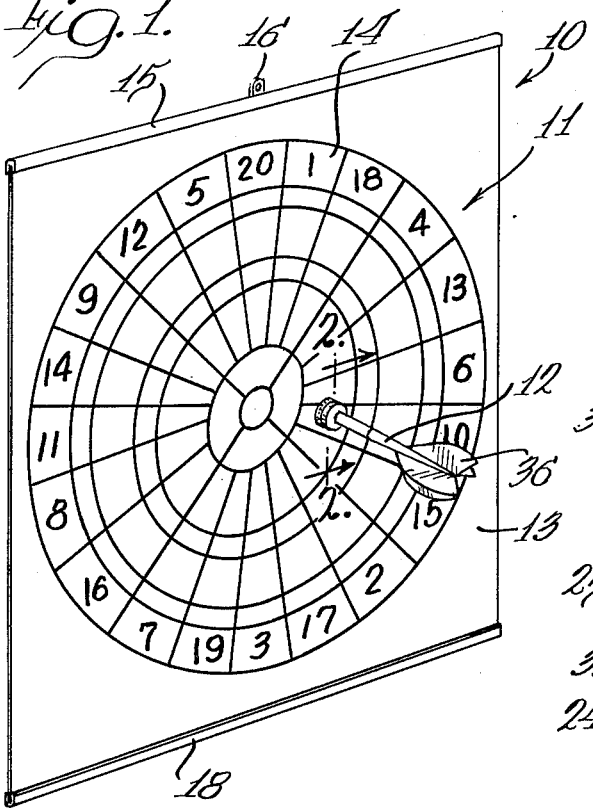
FIG. 1 is a perspective view of a game construction embodying the invention.

In the exemplary embodiment of the invention as shown in the drawing, a game construction generally designated 10 is shown to comprise a target sheet 11 and a dart 12, it being understood that a plurality of such darts may be provided as desired. The target sheet defines a front surface portion 13 on which may be suitably provided, as by printing, a scoring target 14 of any suitable desired configuration. The sheet 11 herein comprises a flexible sheet and is provided at its upper edge with a binding element 15 which may be provided with a suitable hanger 16 for hanging the sheet on a vertical element such as a wall 17 (See FIG. 3.) Similarly the lower edge of the sheet may be provided with a binding element 18 to cooperate with the binding element 15 maintaining the sheet effectively flat against the wall when so hung.

Figure 2:
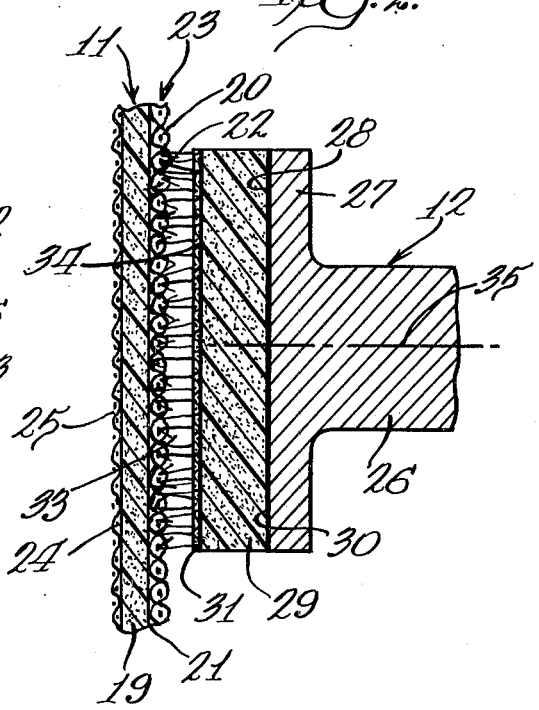
FIG. 2 is a fragmentary enlarged vertical section thereof taken substantially along the line 2—2 of FIG. 1.

As shown in FIG. 2, sheet 11 comprises a composite sheet having a resilient mid-portion 19 which may be formed of a compressible material such as foamed synthetic plastic. Illustratively, sheet portion 19 may be formed of foamed polyurethane plastic. A plurality of fibers 20 are provided on the front surface 21 to define a plurality of interstitial spaces 22. Illustratively the fibers 20 may be provided in the form of a woven fabric generally designated 23. In the illustrated embodiment the fabric comprises a woven nylon textile material.

As further shown in FIG. 2, the rear surface 24 of the foam portion 19 may be provided with a reinforcing fabric 25 which illustratively may comprise a nylon jersey backing fabric.

The dart 12 includes a grasping portion 26 adapted to be grasped by the user's fingers for facilitated throwing of the dart in the normal manner. The forward end of grasping portion 26 defines a laterally enlarged head 27 having a front surface 28 which in the illustrated embodiment defines a circular surface. The pad 29 is mounted on the front head surface 28 by means of a pressure-sensitive adhesive 30. Pad 29 illustratively may be formed of a compressible plastic material such as foamed polyurethane.

On the front surface 31 of pad 29 a hook structure generally designated 32 is provided to define a plurality of barbs 33 carried on a fabric backing 34 to project forwardly therefrom substantially perpendicularly to the front surface 31 of the pad and substantially parallel to the axis 35 of the dart. The barbs 33 are adapted to penetrate the interstitial spaces 22 of the front fabric 23 of the target sheet and to releasably hook with the fibers 20 thereof to hold the dart to the target sheet when the dart is thrown against the sheet as shown in FIG. 1. The interengagement of the barbs and fabric fibers is preselected to be sufficiently strong to hold the dart as shown in FIG. 1 against falling of the dart from the target sheet while yet permitting facilitated removal of the dart from the sheet by a simple rearward urging of the dart.

Figure 3:
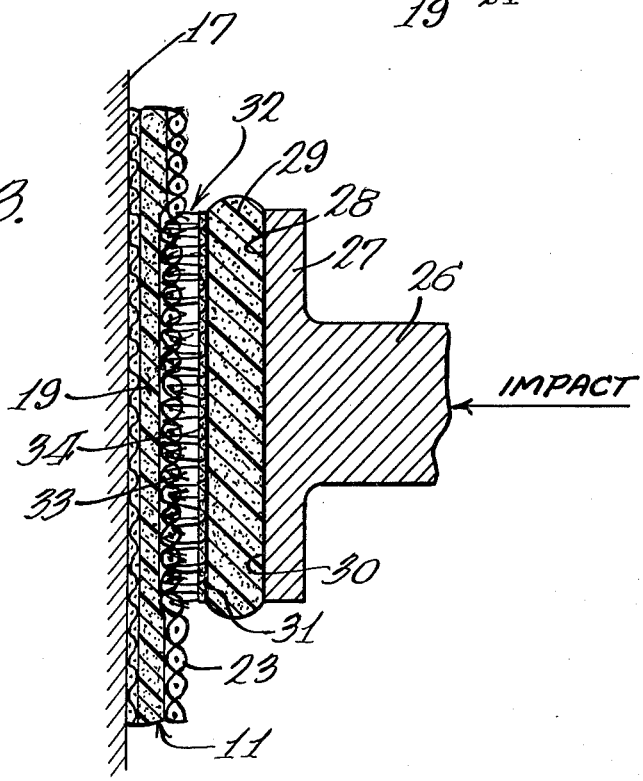
FIG. 3 is a fragmentary vertical section similar to that of FIG. 2 but illustrating the arrangement of the structure as upon impact of the dart with the target sheet.

As shown in FIG. 3, the resilient pad 29 compresses as a result of the inertial force of a relatively heavy grasping portion 26 of the dart, which illustratively may be formed of metal. The compression of the pad thereby absorbs the inertial force and effectively precludes bouncing-off of the dart from the target sheet 11. The small amount of time taken in effecting the compression of the pad has been found to be sufficient to permit the barbs to effectively interlock with the fabric 23 and effectively assure the desired releasable retention of the dart as shown in FIG. 1.

The dart may be provided with a conventional flight 36 which illustratively may be molded of plastic and suitably secured to the outer end of the grasping portion 35. It has been found that a conventional flight construction provides the desired stabilized flight of the dart notwithstanding the relatively large diameter of the nose of the dart, thereby effectively assuring the dart striking the target sheet substantially perpendicularly thereto when thrown thereagainst in the normal manner.

As a result of the flexibility of the target sheet, the sheet may be rolled into a compact configuration whereby the game construction may be stored in minimum space while yet the sheet may be extended to cover a substantial area to provide a relatively large game playing target 14. As a result of the resiliency of the multilayered sheet, the inertial forces of the thrown darts are further absorbed by the sheet and to a large extent by the foam mid-portion 19 which compresses concurrently with the portion of pad 29 at the moment of impact, augmenting the bounce-preventing action of pad 29 and effectively precluding damage to the rearward wall 17 such as where the dart is so badly thrown as to cause the metal mid-portion 27 to strike the target sheet.

Binding element 18 may be made of metal or the like so as to provide a weight at the lower end of the target sheet cooperating with the action of the binding strip in holding the lower edge of the sheet straight to effectively cause the sheet to extend downwardly flat against the wall in the installed arrangement of FIG. 1.

The foregoing disclosure of specific embodiments is illustrative of the broad inventive concepts comprehended by the invention.

I claim:

1. A structure for playing a game, comprising: a target sheet of material having a front flat surface portion comprising a plurality of fibers definng a plurality of interstitial spaces, said sheet including a resilient layer rearwardly supporting said fibers; and a dart having a substantially rigid grasping portion, a rigid flat nose portion at the front end of the grasping portion comprising a flat target contacting element defining a plurality of forwardly projecting barbs adapted to pass into said interstitial spaces and releasably hook said fibers to releasably hold said dart to said sheet as an incident of throwing of the dart to impact said nose portion flatly against said front surface portion, and resilient support means mounting said target contacting element to said grasping portion for absorbing deceleration energy resulting from the impact of the dart against said sheet to effectively preclude bounding-off of said dart nose portion upon impact with said sheet while effectively maintaining the flat configuration of said element on impact.

2. The game playing structure of claim 1 wherein said sheet is flexible.

3. The game playing structure of claim 1 wherein said fibers comprise a woven textile.

4. The game playing structure of claim 1 wherein said resilient support means comprises a pad formed of foamed plastic.

5. The game playing structure of claim 1 wherein said resilient support means comprises a pad of resiliently compressible material adhesively secured to said grasping portion and to said target contacting element.

6. The game playing structure of claim 1 wherein said resilient support means comprises a paid facially secured to said flat nose portion.

7. The game playing structure of claim 1 wherein said resilient support means comprises a pad adhesively facially secured to said flat grasping portion.

8. The game playing structure of claim 1 wherein said resilient support means comprises a pad of resiliently compressible material and said barbs are carried by a rearward base adhesively secured to said pad.

9. The game playing structure of claim 1 wherein said resilient support means comprises a pad of polyurethane foam plastic.

10. The game playing structure of claim 1 wherein said sheet front surface portion comprises a nylon textile fabric.

11. A structure for playing a game, comprising: a target sheet of material having a front flat surface portion comprising a plurality of fibers defining a plurality of interstitial spaces, said sheet including a resilient layer of foam plastic rearwardly supporting said fibers; and a dart having a substantially rigid grasping portion, a rigid flat nose portion at the front end of the grasping portion comprising a flat target contacting element defining a plurality of forwardly projecting barbs adapted to pass into said interstitial spaces and releasably hook said fibers to releasably hold said dart to said sheet as an incident of throwing of the dart to impact said nose portion flatly against said front surface portion, and resilient support means mounting said target contacting element to said grasping portion for absorbing deceleration energy resulting from the impact of the dart against said sheet to effectively preclude bouncing-off of said dart nose portion upon impact with said sheet while effectively maintaining the flat configuration of said element on impact.

12. A structure for playing a game, comprising: a target sheet of material having a front flat surface portion comprising a plurality of fibers defining a plurality of interstitial spaces, said sheet including a resilient layer rearwardly supporting said fibers and a fabric layer rearwardly covering said resilient layer; and a dart having a substantially rigid grasping portion, a rigid flat nose portion at the front end of the grasping portion comprising a flat target contacting element defining a plurality of forwardly projecting barbs adapted to pass into said interstitial spaces and releasably hook said fibers to releasably hold said dart to said sheet as an incident of throwing of the dart to impact said nose portion flatly against said front surface portion, and resilient support means mounting said target contacting element to said grasping portion for absorbing deceleration energy resulting from the impact of the dart against said sheet to effectively preclude bouncing-off of said dart nose portion upon impact with said sheet while effectively maintaining the flat configuration of said element on impact.

* * * * *